US008743102B2

(12) United States Patent
Woo et al.

(10) Patent No.: US 8,743,102 B2
(45) Date of Patent: Jun. 3, 2014

(54) GAMMA TAB VOLTAGE GENERATOR

(75) Inventors: Kyoungdon Woo, Paju-si (KR); Taegung Kim, Paju-si (KR); Mookyoung Hong, Changwon-si (KR)

(73) Assignee: LG Display Co., Ltd., Seoul (KR)

( * ) Notice: Subject to any disclaimer, the term of this patent is extended or adjusted under 35 U.S.C. 154(b) by 147 days.

(21) Appl. No.: 13/478,770

(22) Filed: May 23, 2012

(65) Prior Publication Data

US 2013/0155043 A1 Jun. 20, 2013

(30) Foreign Application Priority Data

Dec. 15, 2011 (KR) ..... 10-2011-0135827

(51) Int. Cl.
*G09G 5/00* (2006.01)

(52) U.S. Cl.
USPC ..... 345/208; 345/94; 341/144; 348/254

(58) Field of Classification Search
USPC ..... 345/208–210, 95–100; 348/254–256, 348/674–677; 341/144–154; 307/15, 31–34
See application file for complete search history.

(56) References Cited

U.S. PATENT DOCUMENTS

2003/0095118 A1* 5/2003 Kato ..... 345/213
2005/0280443 A1* 12/2005 Papanikolaou et al. ..... 326/86

* cited by examiner

*Primary Examiner* — Liliana Cerullo
(74) *Attorney, Agent, or Firm* — Brinks Gilson & Lione

(57) ABSTRACT

A gamma tab voltage generator includes a plurality of, a data calculator configured to generate a buffer selection information and a buffer combination information based on a current capacity of buffer, a plurality of digital-to-analog converters configured to generate gamma tab voltages based on a gamma tab voltage information, a buffer selector configured to connect input terminals of the buffers selected based on the buffer selection information to output terminals of the digital-to-analog converters, and a buffer combiner configured to connect output terminals of the selected buffers to one another in response to the buffer combination information.

7 Claims, 10 Drawing Sheets

FIG. 8

| Gamma Step | Voltage | Single Bank (31" FHD) | | | Dual Bank (55" FHD) | | |
|---|---|---|---|---|---|---|---|
| | | Real Current | Require | Design | Real Current | Require | Design |
| GM0 | 0.00 | 0.27 | 1.00 | 10 | 0.53 | 2.00 | 10 |
| GM1 | 0.10 | 0.75 | 2.00 | 10 | 1.49 | 4.00 | 10 |
| GM2 | 0.48 | 0.83 | 2.00 | 10 | 1.65 | 4.00 | 10 |
| GM3 | 1.17 | 0.91 | 2.00 | 10 | 1.81 | 4.00 | 10 |
| GM4 | 2.20 | 0.96 | 2.00 | 10 | 1.92 | 4.00 | 10 |
| GM5 | 3.59 | 1.01 | 2.00 | 10 | 2.03 | 4.00 | 10 |
| GM6 | 5.36 | 1.04 | 2.00 | 10 | 2.08 | 4.00 | 10 |
| GM7 | 7.52 | 0.85 | 2.00 | 10 | 1.71 | 4.00 | 10 |
| GM8 | 10.00 | 6.61 | 10.00 | 10 | 13.23 | 20.00 | 10 |
| Total Current | | 13.23 | 25.00 | 90.00 | 26.45 | 50.00 | 90.00 |

FIG. 9

| | Related art | | Embodiment of the invention | |
|---|---|---|---|---|
| | Current | Qty | Current | Qty |
| AMP Current | 10 | 9 | 10 | 2 |
| | | | 5 | 5 |
| | | | 3 | 6 |
| | | | 2 | 9 |
| | | | 1 | 9 |
| TOTAL | 90 | | 90 | |

FIG. 10

| 31″ FHD | Load | Related art | | | Embodiment of the invention | | |
|---|---|---|---|---|---|---|---|
| | | Current | Qty | TOTAL | Current | Qty | TOTAL |
| GM0 | 1.00 | 10.00 | 1 | 10 | 1.00 | 1 | 1.00 |
| GM1 | 2.00 | 10.00 | 1 | 10 | 2.00 | 1 | 2.00 |
| GM2 | 2.00 | 10.00 | 1 | 10 | 2.00 | 1 | 2.00 |
| GM3 | 2.00 | 10.00 | 1 | 10 | 2.00 | 1 | 2.00 |
| GM4 | 2.00 | 10.00 | 1 | 10 | 2.00 | 1 | 2.00 |
| GM5 | 2.00 | 10.00 | 1 | 10 | 2.00 | 1 | 2.00 |
| GM6 | 2.00 | 10.00 | 1 | 10 | 2.00 | 1 | 2.00 |
| GM7 | 2.00 | 10.00 | 1 | 10 | 2.00 | 1 | 2.00 |
| GM8 | 10.00 | 10.00 | 1 | 10 | 10.00 | 1 | 10.00 |
| Total Current | 25.00 | 90.00 | | | 25.00 | | |
| % Total | 28% | 100% | | | 28% | | |

FIG. 11

| 55″ FHD | Load | Related art | Embodiment of the invention | | | | |
|---|---|---|---|---|---|---|---|
| | | | First AMP | | Second AMP | | TOTAL |
| | | | Current | Qty | Current | Qty | |
| GM0 | 2.00 | Not Support | 2.00 | 1 | | | 2.00 |
| GM1 | 4.00 | | 2.00 | 2 | | | 4.00 |
| GM2 | 4.00 | | 2.00 | 2 | | | 4.00 |
| GM3 | 4.00 | | 2.00 | 2 | | | 4.00 |
| GM4 | 4.00 | | 2.00 | 2 | | | 4.00 |
| GM5 | 4.00 | | 3.00 | 1 | 1.00 | 1 | 4.00 |
| GM6 | 4.00 | | 3.00 | 1 | 1.00 | 1 | 4.00 |
| GM7 | 4.00 | | 3.00 | 1 | 1.00 | 1 | 4.00 |
| GM8 | 20.00 | | 10.00 | 2 | | | 20.00 |
| Total Current | 50.00 | 90.00 | 50.00 | | | | |
| % Total | 56% | 100% | 56% | | | | |

GAMMA TAB VOLTAGE GENERATOR

This application claims the priority and the benefit under 35 U.S.C. §119(a) on Patent Application No. 10-2011-0135827 filed in Republic of Korea on Dec. 15, 2011, the entire contents of which are hereby incorporated by reference.

BACKGROUND

1. Field of the Invention

Embodiments of the disclosure relate to a gamma tab voltage generator.

2. Discussion of the Related Art

Flat panel displays such as a liquid crystal display and an organic light emitting diode (OLED) display convert a data voltage into a gamma compensation voltage and supply the gamma compensation voltage to pixels of a display panel. The OLED display has a self-emission structure in which an OLED is formed in each pixel of the display panel.

The gamma compensation voltage is set along a nonlinear curve. The nonlinear curve is divided into several steps, so that the gamma compensation voltage is implemented along the nonlinear curve. Voltages of each step are set to gamma tab voltages (or gamma reference voltages). A gamma integrated circuit (IC) generates the gamma tab voltages using a plurality of buffers. The buffers are generally designed to have a maximum current capacity capable of generating a maximum gamma tab voltage irrespective of a difference between the gamma tab voltages. Because of this, the related art gamma IC includes the plurality of buffers having an unnecessarily large current capacity. Thus, power consumption and an amount of heat generated in the related art gamma IC increase, and the size of the related art gamma IC increases.

The gamma IC commonly supplies the gamma tab voltages to source driver ICs of a data driving circuit. Because the gamma IC has a fixed buffer capacity, extensibility and compatibility of the gamma IC are reduced. Thus, it is difficult for the related art gamma IC to cope with changes in a resolution of the display panel. For example, when the number of source driver ICs increases due to an increase in the resolution of the display panel, the gamma IC has to output a current equal to or greater than the maximum current of the gamma IC. Thus, the gamma IC has to be newly designed.

BRIEF SUMMARY

In one aspect, there is a gamma tab voltage generator including a plurality of buffers, a data calculator configured to generate a buffer selection information and a buffer combination information, a plurality of digital-to-analog converters configured to generate gamma tab voltages based on a gamma tab voltage information, a buffer selector configured to connect input terminals of the buffers selected based on the buffer selection information to output terminals of the digital-to-analog converters, and a buffer combiner configured to connect output terminals of the selected buffers to one another in response to the buffer combination information.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings:

FIG. 8 illustrates extensible related data of a related art gamma IC;

FIG. 9 illustrates a current capacity of a buffer embedded in a gamma IC and the number of buffers in a related art and an example embodiment of the invention;

FIG. 10 illustrates a reduction effect of the size of a gamma IC in a related art and an example embodiment of the invention; and FIG. 11 illustrates an improvement effect of extensibility of a gamma IC in a related art and an example embodiment of the invention.

DETAILED DESCRIPTION OF THE DRAWINGS AND THE PRESENTLY PREFERRED EMBODIMENTS

Figure 1:
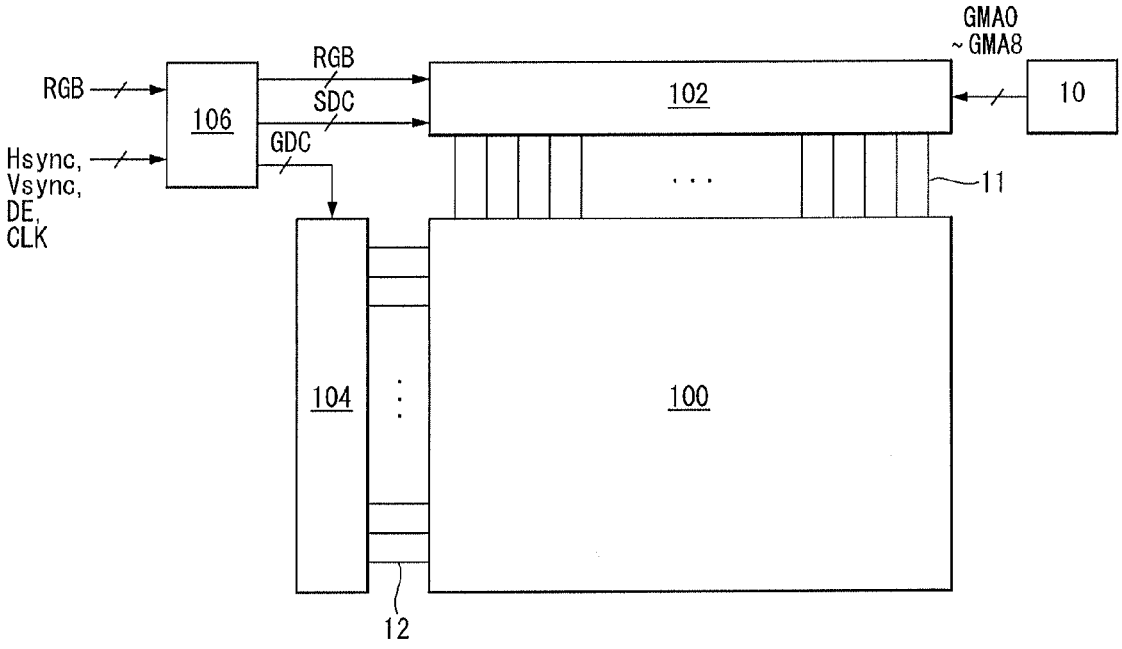
FIG. 1 is a block diagram of a display device according to an example embodiment of the invention.

Reference will now be made in detail to embodiments of the invention, examples of which are illustrated in the accompanying drawings. Wherever possible, the same reference numbers will be used throughout the drawings to refer to the same or like parts. It will be paid attention that detailed description of known arts will be omitted if it is determined that the arts can mislead the embodiments of the invention.

As shown in FIGS. 1 to 4, a display device according to an example embodiment of the invention includes a display panel 100, a display panel driving circuit, a programmable gamma tab voltage generator 10, etc.

The display panel 100 may be implemented as a display panel of a flat panel display requiring a gamma compensation voltage, such as a liquid crystal display and an organic light emitting diode (OLED) display. The display panel 100 includes data lines 11, scan lines (or gate lines) 12 crossing the data lines 11, pixels arranged in a matrix form, etc. The pixels may include a switching element or a driving element implemented as a thin film transistor (TFT) and a self-emitting element such as an OLED.

In the case of the liquid crystal display, a backlight unit may be disposed under the display panel 100.

The display panel driving circuit includes a data driving circuit 102, a scan driving circuit 104, and a timing controller 106 and writes data of an input image to the pixels of the display panel 100. The data driving circuit 102 converts digital video data RGB received from the timing controller 106 into a gamma compensation voltage and outputs a data voltage. The data driving circuit 102 may include a plurality of source driver integrated circuits (ICs) S-IC. The data voltage output from the data driving circuit 102 is supplied to the data lines 11. The scan driving circuit 104 sequentially supplies a scan pulse (or a gate pulse) synchronized with the data voltage to the scan lines 12 and selects lines of the display panel 100 to which the data voltage is written.

The timing controller 106 receives the digital video data RGB of the input image from an external host system and transfers the digital video data RGB to the data driving circuit 102. The timing controller 106 generates a data timing control signal SDC and a scan timing control signal GDC for respectively controlling operation timings of the data driving circuit 102 and the scan driving circuit 104 based on the digital video data RGB of the input image and timing signals received from the host system. The timing signals received from the host system include a vertical sync signal Vsync, a horizontal sync signal Hsync, a data enable DE, a main clock MCLK, etc. The vertical sync signal Vsync and the horizontal sync signal Hsync may be omitted, if desired.

The programmable gamma tab voltage generator 10 receives digital data including gamma tab voltage information and resistance information, selects a voltage to be input to buffers embedded in the programmable gamma tab voltage generator 10, and combines the buffers to which the selected voltage is input. The resistance information includes a resistance value of a voltage divider of the source driver IC shown in FIG. 2. Tables shown in FIGS. 8 to 11 are made by calculation values obtained when the resistance value of the voltage divider of the source driver IC is set to about 3 kΩ.

The programmable gamma tab voltage generator 10 outputs gamma tab voltages GMA0 to GMA8 through the combination of the selected buffers. The gamma tab voltages GMA0 to GMA8 are commonly supplied to the source driver ICs S-IC of the data driving circuit 102. The programmable gamma tab voltage generator 10 may be integrated into a gamma IC.

Figure 2:
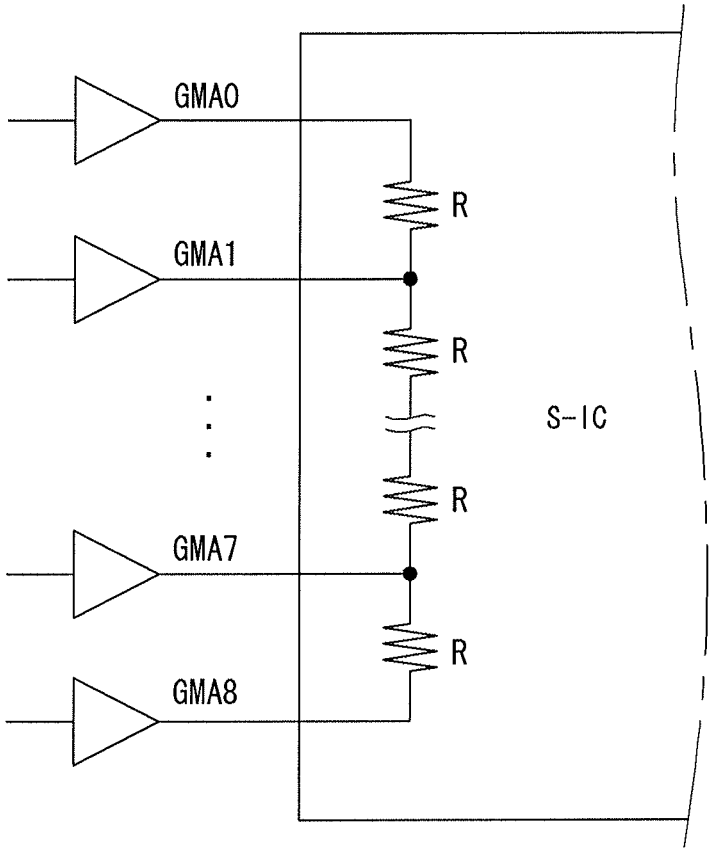
FIG. 2 illustrates a resister string of a source driver integrated circuit (IC)
Figure 3:
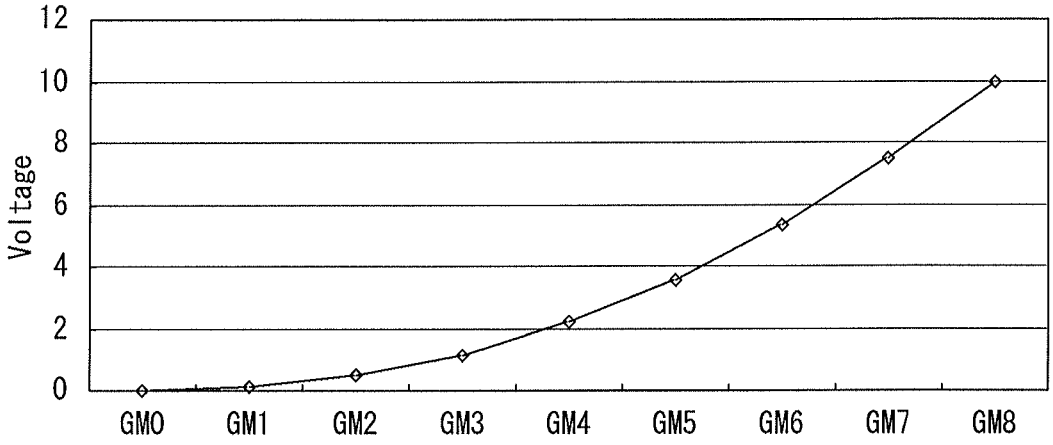
FIG. 3 is a graph illustrating an example of a gamma compensation voltage curve.

Each of the source driver ICs S-IC divides the gamma tab voltages GMA0 to GMA8 using the voltage divider embedded in it and generates divided gamma compensation voltages at each gray level of the input image data. As shown in FIG. 2, the voltage divider includes a resistor string including a plurality of resistors R connected in series to one another. As shown in FIG. 3, the gamma compensation voltages may be set to voltages according to a 2.2 gamma curve. The gamma tab voltages GMA0 to GMA8 are set to voltages of each step when voltages between a minimum gamma compensation voltage and a maximum gamma compensation voltage are divided into several steps, for example, seven steps.

Figure 4:
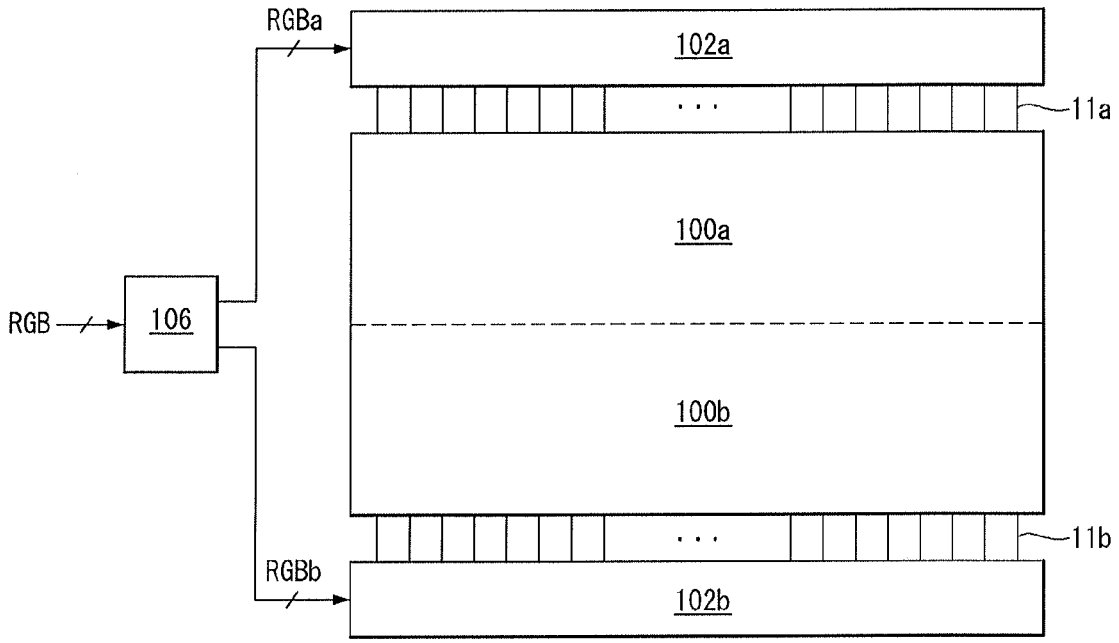
FIG. 4 schematically illustrates an example of a display panel having a double bank structure.

The display panel 100 shown in FIG. 1 is an example of a single bank structure in which the data lines 11 of the display panel 100 are not divided. If a resolution and the size of the display panel 100 increase, the display panel 100 may have a double bank structure. As shown in FIG. 4, a pixel array of the display panel 100 having the double bank structure is divided into an upper half part 100*a* and a lower half part 100*b*. In the double bank structure, because a length of each data line 11 decreases, a drop of the data voltage resulting from parasitic capacitances and parasitic resistances of the data lines 11 may be prevented or reduced. The data lines 11 are divided into data lines 11*a* formed on the upper half part 100*a* and data lines 11*b* formed on the lower half part 100*b* along a middle line (indicated by dotted line of FIG. 4) of the display panel 100. The data lines 11*a* of the upper half part 100*a* are connected to a first data driving circuit 102*a* positioned at the upper side of the display panel 100 and receive the data voltage from the first data driving circuit 102*a*. The data lines 11*b* of the lower half part 100*b* are connected to a second data driving circuit 102*b* positioned at the lower side of the display panel 100 and receive the data voltage from the second data driving circuit 102*b*. Each of the first and second data driving circuits 102*a* and 102*b* may include source driver ICs. The timing controller 106 synchronizes operation timings of the first and second data driving circuits 102*a* and 102*b* with each other.

Figure 5:
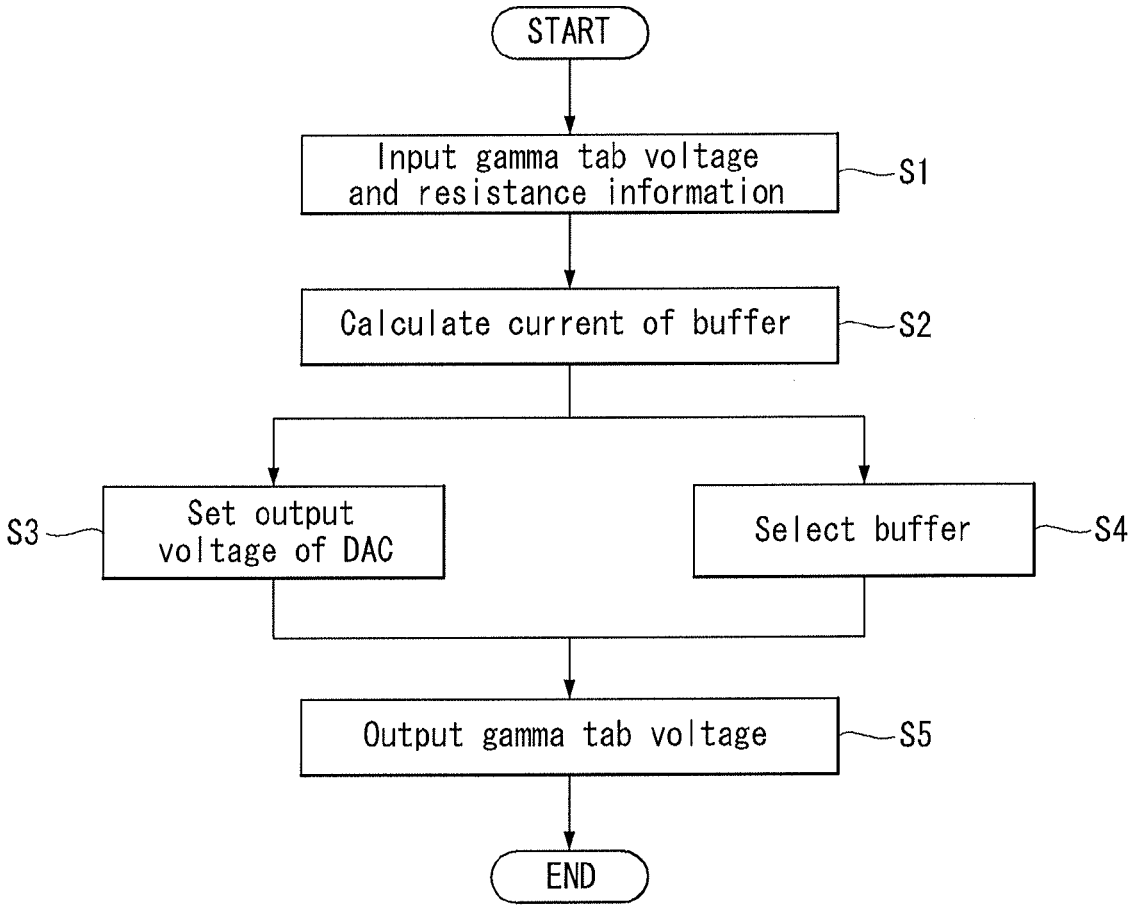
FIG. 5 is a flow chart illustrating a method for setting a gamma tab voltage according to an example embodiment of the invention.
Figure 6:
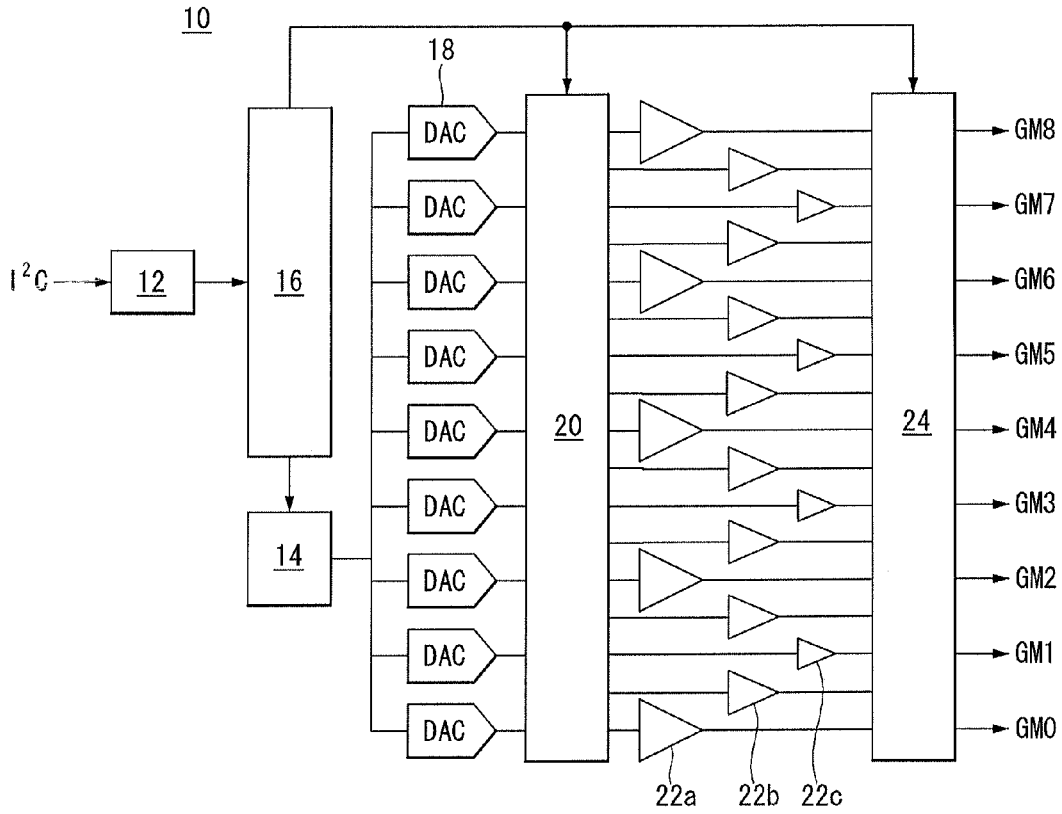
FIG. 6 illustrates a circuit configuration of a programmable gamma tab voltage generator according to an example embodiment of the invention.
Figure 7:
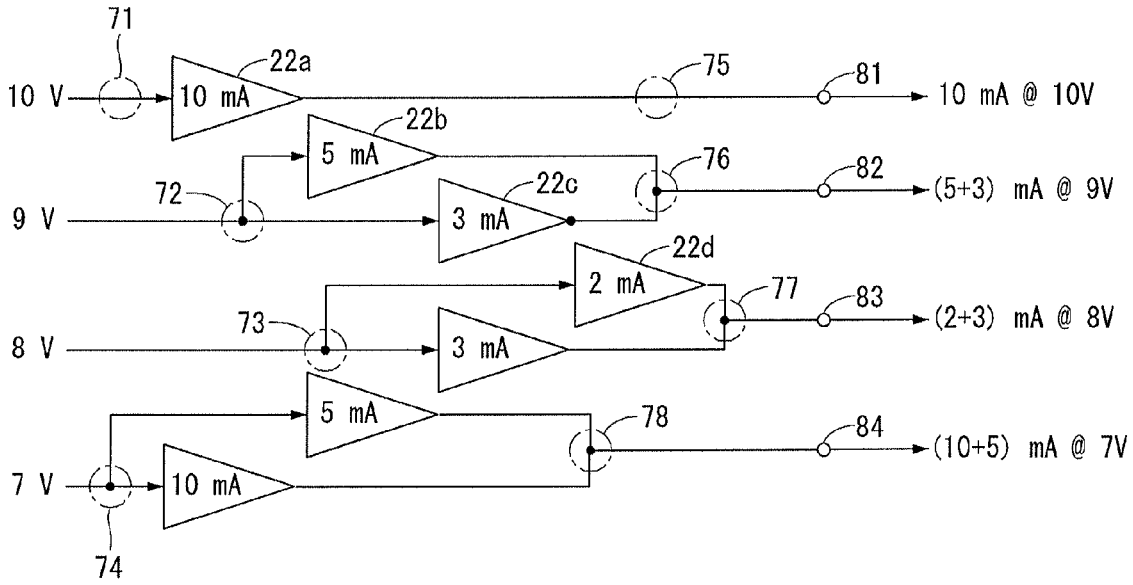
FIG. 7 illustrates an operational example of a buffer selector and a buffer combiner shown in FIG. 6.

FIG. 5 is a flow chart illustrating a method for setting the gamma tab voltage according to the embodiment of the invention. FIG. 6 illustrates a circuit configuration of the programmable gamma tab voltage generator according to the embodiment of the invention. FIG. 7 illustrates an operational example of a buffer selector and a buffer combiner shown in FIG. 6.

As shown in FIGS. 5 to 7, the programmable gamma tab voltage generator 10 includes a control interface 12, a data calculator 16, a register 14, digital-to-analog converters (DACs) 18, a buffer selector 20, buffers 22*a* to 22*d*, a buffer combiner 24, etc.

The buffers 22*a* to 22*d* include buffers having various current capacities. The buffers may be include buffers having same current capacity. Each of the buffers 22*a* to 22*d* is implemented by an operational amplifier (op-amp). For example, as shown in FIG. 7, the buffers 22*a* to 22*d* may include a plurality of first buffers 22*a* having a current capacity of about 10 mA, a plurality of second buffers 22*b* having a current capacity of about 5 mA, a plurality of third buffers 22*c* having a current capacity of about 3 mA, a plurality of fourth buffers 22*d* having a current capacity of about 2 mA, and a plurality of fifth buffers (not shown) having a current capacity of about 1 mA. When the current capacity is reduced, the size of the buffer is reduced because the channel size in a transistor inside the op-amp is reduced.

A serial clock and serial data synchronized with the serial clock are input to the programmable gamma tab voltage generator 10 through $I^2C$ communication. Gamma data transferred to the serial data includes the gamma tab voltage and the resistance information in step S1. The gamma data may change. Thus, a maker of the display device may change a buffer current capacity and a buffer combination inside the programmable gamma tab voltage generator 10 using the gamma data. Further, the maker of the display device may adjust the gamma tab voltages GMA0 to GMA8 output from the programmable gamma tab voltage generator 10.

The control interface 12 supplies the gamma data to the data calculator 16. The control interface 12 generates memory read/write enable signals for controlling data input/output operations of the register 14.

The data calculator 16 calculates current capacities of the buffers 22*a* to 22*d* required to obtain each of the gamma tab voltages GMA0 to GMA8 based on the gamma tab voltage information and the resistance information read from the gamma data in step S2. The resistance information includes the resistance value of the resistor string inside the source driver IC. The data calculator 16 generates buffer selection informations and buffer combination informations based on the current capacities of the buffers 22*a* to 22*d* calculated for each of the gamma tab voltages GMA0 to GMA8. The buffer selection information includes information for connecting input terminals of the buffers 22*a* to 22*d* selected to obtain the current capacities of the buffers 22*a* to 22*d*. The buffer combination information includes information for connecting output terminals of the buffers 22*a* to 22*d* so as to combine outputs of the selected buffers 22*a* to 22*d*. The data calculator 16 supplies the gamma tab voltage information of the gamma data to the register 14.

The register 14 stores the gamma tab voltage information of the gamma data received from the data calculator 16 under the control of the control interface 12 and supplies the gamma tab voltage information to the DACs 18. The register 14 sets an output voltage of each of the DACs 18 in step S3.

The gamma data is independently applied to each of the DACs 18. Each of the DACs 18 outputs a gamma tab voltage Vtab varying depending on gamma tab voltage information GMA of the gamma data as indicated in Equation (1).

$$Vtab = \frac{VDD}{n} \times GMA \quad (1)$$

In Equation (1), 'VDD' is a high potential power voltage, and 'n' is a maximum gray level of pixel data. For example, when the high potential power voltage VDD is 20V, the DAC 18, to which the gamma data including the gamma tab voltage information GMA of "180" is input, outputs the gamma tab voltage Vtab of 14.12V (=(20×180)/255).

The buffer selector 20 selects the buffers 22*a* to 22*d*, to which the output voltage of the DACs 18 is supplied, in step S4. The buffer selector 20 includes a switch array for switching on or off a current path between output terminals of the DACs 18 and the input terminals of the buffers 22*a* to 22*d* in response to the buffer selection information received from the data calculator 16.

In the operational example illustrated in FIG. 7, the switch array of the buffer selector 20 connects the input terminal of the first buffer 22*a* having the current capacity of about 10 mA to the output terminal of the first DAC 18 having the output voltage of about 10V in response to first buffer selection information. As a result, the buffer selector 20 may supply the voltage of about 10V output from the first DAC 18 to the first buffer 22*a* in response to the first buffer selection information.

The switch array of the buffer selector 20 connects the input terminal of the second buffer 22*b* having the current capacity of about 5 mA and the input terminal of the third buffer 22*c* having the current capacity of about 3 mA to the output terminal of the second DAC 18 having the output voltage of about 9V in response to second buffer selection information. As a result, the buffer selector 20 may supply the voltage of about 9V output from the second DAC 18 to the second and third buffers 22*b* and 22*c* having the current capacity of about 8 mA in response to the second buffer selection information.

The switch array of the buffer selector 20 connects the input terminal of the third buffer 22*c* having the current capacity of about 3 mA and the input terminal of the fourth buffer 22*d* having the current capacity of about 2 mA to the output terminal of the third DAC 18 having the output voltage of about 8V in response to third buffer selection information. As a result, the buffer selector 20 may supply the voltage of about 8V output from the third DAC 18 to the third and fourth buffers 22*c* and 22*d* in response to the third buffer selection information.

As described above, the buffer selector 20 connects the input terminals of the buffers 22*a* to 22*d* to the output terminals of the DACs 18, so as to meet the current capacity indicated by the buffer selection information received from the data calculator 16. The method for connecting the input terminals of the buffers 22*a* to 22*d* to the output terminals of the DACs 18 is not limited to the method illustrated in FIG. 7. Various methods may be used depending on the buffer selection information. In FIG. 7, reference numerals 71 to 74 denote nodes selectively connected current paths the DACs 18 to the buffers 22*a* to 22*d* by switch elements of the buffer selector 20 on the current path between the DACs 18 and the buffers 22*a* to 22*d*. The nodes 71 to 74 are selectively shorted or opened by the switch elements of the buffer selector 20 based on current values of the buffer selection information received from the data calculator 16.

The buffer combiner 24 connects the output terminals of the buffers 22*a* to 22*d* to one another in response to current values of the buffer combination information received from the data calculator 16. The buffer combiner 24 includes a switch array for switching on or off a current path between the output terminals of the buffers 22*a* to 22*d* and gamma tab voltage output terminals 81 to 84 in response to the buffer combination information received from the data calculator 16.

In the operational example illustrated in FIG. 7, the switch array of the buffer combiner 24 connects the output terminal of the first buffer 22*a* having the current capacity of about 10 mA to the first gamma tab voltage output terminal 81 in response to first buffer combination information. As a result, the buffer combiner 24 outputs the current of about 10 mA generated by the first buffer 22*a*, to which the voltage of about 10V is applied, through the first gamma tab voltage output terminal 81 in step S5.

The switch array of the buffer combiner 24 connects the output terminal of the second buffer 22*b* having the current capacity of about 5 mA and the output terminal of the third buffer 22*c* having the current capacity of about 3 mA to the second gamma tab voltage output terminal 82 in response to second buffer combination information. As a result, the buffer combiner 24 outputs the current of about 8 mA generated by the second and third buffers 22*b* and 22*c*, to which the voltage of about 9V is applied, through the second gamma tab voltage output terminal 82.

The switch array of the buffer combiner 24 connects the output terminal of the third buffer 22*c* having the current capacity of about 3 mA and the output terminal of the fourth buffer 22*d* having the current capacity of about 2 mA to the third gamma tab voltage output terminal 83 in response to third buffer combination information. As a result, the buffer combiner 24 outputs the current of about 5 mA generated by the third and fourth buffers 22*c* and 22*d*, to which the voltage of about 8V is applied, through the third gamma tab voltage output terminal 83.

As described above, the buffer combiner 24 connects the output terminals of the buffers 22*a* to 22*d* to the gamma tab voltage output terminals 81 to 84, so as to meet the current capacity indicated by the buffer combination information received from the data calculator 16. The method for connecting the output terminals of the buffers 22*a* to 22*d* to the gamma tab voltage output terminals 81 to 84 is not limited to the method illustrated in FIG. 7. Various methods may be used depending on the buffer combination information. In FIG. 7, reference numerals 75 to 78 denote nodes selectively connected current paths the buffers 22*a* to 22*d*, to the gamma tab voltage output terminals 81 to 84 by switch elements of the buffer combiner 24 on a current path between the buffers 22*a* to 22*d* and the gamma tab voltage output terminals 81 to 84. The nodes 75 to 78 are selectively shorted or opened by the switch elements of the buffer combiner 24 based on current values of the buffer combination informations received from the data calculator 16.

Consequently, the buffer selector 20 and the buffer combiner 24 combine the buffers 22*a* to 22*d* between the DACs 18 and the gamma tab voltage output terminals 81 to 84, so as to meet the current capacities of the buffers 22*a* to 22*d* generating the gamma tab voltages GMA0 to GMA8.

FIG. 8 illustrates extensible related data of a related art gamma IC. More specifically, FIG. 8 is a table for comparing a buffer current capacity of a gamma IC required to supply the gamma tab voltages GMA0 to GMA8 to a 31" display panel having a single bank structure of an OLED display with a buffer current capacity of a gamma IC required to supply the gamma tab voltages GMA0 to GMA8 to a 55" display panel having a double bank structure of an OLED display. In FIG. 8, 'Real current' is a current (unit: mA) output from the buffer when each of the gamma tab voltages GMA0 to GMA8 is generated, and 'Require' is a current (unit: mA) of the buffer required to generate each of the gamma tab voltages GMA0 to GMA8. Further, 'Design' is a designed current (unit: mA) of the buffer embedded in the gamma IC so as to produce each of the gamma tab voltages GMA0 to GMA8.

In the related art, the gamma IC for supplying the gamma tab voltages GMA0 to GMA8 to the 31" display panel having the single bank structure of the OLED display was designed so that the buffers generating the gamma tab voltages GMA0 to GMA8 have the current capacity of about 10 mA suitable for a current capacity of the maximum gamma tab voltage GMA8. Thus, the related art gamma IC was designed so that a sum of currents of the buffers generating the gamma tab voltages GMA0 to GMA8 is about 90 mA, in spite of the fact that a sum of currents of the buffers required to generate the gamma tab voltages GMA0 to GMA8 is about 25 mA. As a result, the related art gamma IC consumes an unnecessarily large amount of current in generating the gamma tab voltages GMA0 to GMA8, and the size of the buffers increases.

The related art gamma IC designed for the 31" display panel cannot be applied to the 55" display panel. As can be seen from a hatched portion of FIG. 8, the current capacity of the buffer required to supply the maximum gamma tab voltage GMA8 to the 55" display panel is about 20 mA. However, the related art gamma IC designed for the 31" display panel does not have the buffer having the current capacity of about 20 mA.

On the other hand, as shown in FIGS. 9 to 11, the gamma IC according to the embodiment of the invention may select the current capacities of the buffers required to produce each of the gamma tab voltages GMA0 to GMA8 in conformity with the required current 'Require' of FIG. 8. Thus, the embodiment of the invention may prevent or reduce the excessive current consumption of the gamma IC and an excessive increase in the size of the gamma IC. Further, because the embodiment of the invention may adaptively select and combine the current capacities of the buffers, extensibility and compatibility of the gamma IC for various models of the display panels may increase.

FIG. 9 illustrates the current capacity of the buffer embedded in the gamma IC and the number of buffers in the related art and the embodiment of the invention. In FIG. 9, 'Qty' indicates the number of buffers.

As shown in FIG. 9, the related art gamma IC designed for the 31" display panel having the single bank structure of the OLED display includes the nine buffers each having the current capacity of about 10 mA therein. The gamma IC according to the embodiment of the invention includes the two buffers each having the current capacity of about 10 mA, the five buffers each having the current capacity of about 5 mA, the six buffers each having the current capacity of about 3 mA, the nine buffers each having the current capacity of about 2 mA, and the nine buffers each having the current capacity of about 1 mA, so as to meet the buffer current capacity of the 31" display panel having the single bank structure of the OLED display and the buffer current capacity of the 55" display panel having the double bank structure of the OLED display. The number of buffers embedded in the gamma IC according to the embodiment of the invention and the buffer current capacity are not limited to an example illustrated in FIG. 9, and may be variously changed.

The nine buffers are embedded in the related art gamma IC and each have the current capacity of about 10 mA. Thus, because the related art gamma IC includes the buffers each having the large current capacity, the size of the related art gamma IC necessarily increases. On the other hand, the 31 buffers are embedded in the gamma IC according to the embodiment of the invention, but mostly have the small current capacity equal to or less than about 5 mA. Thus, because the gamma IC according to the embodiment of the invention includes the buffers mostly having the small current capacity, the size of the gamma IC is greatly reduced compared to the related art gamma IC.

FIG. 10 illustrates a reduction effect of the size of the gamma IC in the related art and the embodiment of the invention. In FIG. 10, 'Load' indicates the required current 'Require' in the single bank structure of FIG. 8.

As shown in FIG. 10, the related art gamma IC designed for the 31" display panel having the single bank structure of the OLED display uses the nine buffers each having the current capacity of about 10 mA so as to generate each of the gamma tab voltages GMA0 to GMA8. Therefore, the nine buffers are designed to have the total current capacity of about 90 mA.

On the other hand, the gamma IC according to the embodiment of the invention select the current capacity of the buffers close to a current capacity of a practically required load 'Load', so as to generate the gamma tab voltages GMA0 to GMA8. The gamma IC according to the embodiment of the invention designed for the 31" display panel having the single bank structure of the OLED display generates the gamma tab voltage GMA0 through one buffer having the current capacity of about 1 mA, generates the gamma tab voltages GMA1 to GMA7 through one buffer having the current capacity of about 2 mA, and generates the gamma tab voltage GMA8 through one buffer having the current capacity of about 10 mA. The current capacity of the buffer generating the low gamma tab voltage is small, and the current capacity of the buffer generating the high gamma tab voltage is large. Thus, the gamma IC according to the embodiment of the invention designed for the 31" display panel having the single bank structure of the OLED display is designed to include the buffers having the total current capacity of about 25 mA. The gamma IC according to the embodiment of the invention designed for the 31" display panel having the single bank structure of the OLED display recombines the buffers, thereby supporting the 55" display panel having the double bank structure of the OLED display.

FIG. 11 illustrates an improvement effect of extensibility of the gamma IC in the related art and the embodiment of the invention.

As shown in FIG. 11, the related art gamma IC designed for the 31" display panel having the single bank structure of the OLED display does not meet the current capacity of the maximum gamma tab voltage GMA8, and thus cannot support the 55" display panel having the double bank structure of the OLED display. On the other hand, the gamma IC according to the embodiment of the invention connects the two buffers each having the current capacity of about 10 mA to each other, thereby meeting the current capacity of the maximum gamma tab voltage GMA8. Therefore, the gamma IC according to the embodiment of the invention can support the 55" display panel having the double bank structure of the OLED display. As described above, the gamma IC according to the embodiment of the invention generates the buffer selection information and the buffer combination information based on the current values calculated by the data calculator and connects the buffers to one another through various combinations based on the buffer selection information and the buffer combination information, thereby supporting various models and the resolution of the display panels.

As described above, the gamma tab voltage generator according to the embodiment of the invention combines the buffers having the various current capacities of the gamma IC based on the output of the data calculator and generates the gamma tab voltages. Thus, the gamma tab voltage generator according to the embodiment of the invention can reduce power consumption and an amount of heat generated in the gamma IC and can reduce the size of the gamma IC. Further, the gamma tab voltage generator according to the embodiment of the invention can improve the extensibility and the compatibility of the gamma IC.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

The invention claimed is:

1. A gamma tab voltage generator supplying gamma tab voltages to a source driver which converts a digital video data into a data voltage to be supplied to data lines of a display panel, the comprising:

a plurality of buffers supplying the gamma tab voltages to the source driver;

a data calculator configured to generate buffer selection information and buffer combination information based on a current capacity of a buffer;

a plurality of digital-to-analog converters configured to generate the gamma tab voltages based on gamma tab voltage information;

a buffer selector configured to select buffers based on the buffer selection information and connect input terminals of the selected buffers to output terminals of the digital-to-analog converters; and a buffer combiner configured to connect output terminals of the selected buffers to one another in response to the buffer combination information.

2. The gamma tab voltage generator of claim 1, wherein the data calculator receives digital data including the gamma tab voltage information and a resistance information and calculates the current capacity of buffer based on the gamma tab voltage information and the resistance information, wherein the data calculator generates the buffer selection information and the buffer combination information so as to select the buffers capable of obtaining the calculated current capacity of buffer.

3. The gamma tab voltage generator of claim 1, wherein the plurality of buffers include at least first and second buffers each having a different current capacity.

4. The gamma tab voltage generator of claim 3, wherein the gamma tab voltages include first and second gamma tab voltages each having a different value, wherein the buffer selector supplies the first gamma tab voltage to the first buffer and supplies the second gamma tab voltage to the second buffer.

5. The gamma tab voltage generator of claim 1, wherein the plurality of buffers include at least first to third buffers each having a different current capacity.

6. The gamma tab voltage generator of claim 5, wherein the gamma tab voltages include first and second gamma tab voltages each having a different value, wherein the buffer selector supplies the first gamma tab voltage to the first buffer and commonly supplies the second gamma tab voltage to the second and third buffers.

7. The gamma tab voltage generator of claim 6, wherein the buffer combiner connects output terminals of the second and third buffers to one another.

* * * * *